United States Patent [19]

Ulrich

[11] 4,300,579

[45] Nov. 17, 1981

[54] PROCESS FOR THE MANUFACTURE OF A TOBACCO RIB CUT HAVING AN IMPROVED FILLING CAPACITY

[75] Inventor: Jörn Ulrich, Hamburg, Fed. Rep. of Germany

[73] Assignee: B.A.T. Cigaretten-Fabriken GmbH, Hamburg, Fed. Rep. of Germany

[21] Appl. No.: 137,325

[22] Filed: Apr. 4, 1980

[30] Foreign Application Priority Data

Apr. 6, 1979 [DE] Fed. Rep. of Germany ..... 2913823

[51] Int. Cl.[3] ..... A24B 3/18

[52] U.S. Cl. ..... 131/290; 131/291

[58] Field of Search ..... 131/140 R, 140 P, 120, 131/145, 146, 147 R, 290, 291, 292, 293, 294, 324, 295, 325, 296, 309, 352, 312, 900, 311

[56] References Cited

U.S. PATENT DOCUMENTS 4,076,030 2/1978 Smith ..... 131/140 P

*Primary Examiner*—V. Millin

*Attorney, Agent, or Firm*—Bierman & Bierman

[57] ABSTRACT

A method for the treatment of tobacco stems which comprises providing the tobacco stems in the uncut condition with a moisture content ranging from 15 to 70% relative to the dry weight of the tobacco stems, performing at least one first cut of said tobacco stems in a direction parallel to the longitudinal axis thereof, conditioning the resultingly cut tobacco stems, and performing more than one second cut of said tobacco stems in a direction parallel to said longitudinal axis, wherein the respective longitudinal planes containing said first and said second cuts reside in substantially perpendicular relation to each other. The resulting tobacco stem sections exhibit improved uniformity of length and thickness, and minimal fiber destruction, and have improved expansion capacity.

4 Claims, No Drawings

PROCESS FOR THE MANUFACTURE OF A TOBACCO RIB CUT HAVING AN IMPROVED FILLING CAPACITY

BACKGROUND OF THE INVENTION

The invention relates to a process for treating tobacco stems to increase their filling capacity, and specifically to a method of cutting and conditioning said tobacco stems to obtain cut stem sections that are generally uniform in size.

The art of treating tobacco stems by some form of cutting to produce stem sections having generally uniform size suitable for use as filler material and smoking articles is well known in several variations. Thus, U.S. Pat. No. 3,734,104, discloses a process for treating tobacco stems wherein the tobacco stems are first rolled or crushed prior to being cut to filler size. This particular method suffers from the disadvantage that the rolling or crushing procedure tends to destroy the fiber structure of the tobacco stem, and also results in the production of tobacco stem sections that vary widely in length. Also, as the cut tobacco stem sections are frequently subsequently expanded by steam treatment or the like, the destruction of the fiber structure that occurs from the rolling treatment tends to cause undesirable variations in the extent of expansion of the stem sections.

U.S. Pat. No. 3,556,112 discloses a method for treating tobacco stems which comprises initially expanding or puffing the stems, and subsequently cutting the puffed or expanded stems in a cutting direction parallel to the direction of the stem fibers. This method, like that of the '104 patent, is deficient in that the preliminary expansion treatment likewise causes the destruction of the fiber structure of the stems and weakens the stems such that a quantity of particulate material or dust is developed when the stems are subsequently cut. The resulting stem sections are therefore frequently non-uniform in size and the development of dust from the cutting operation detracts from the usable filler material obtained from the treatment process.

Finally, U.S. Pat. No. 4,076,030 discloses a method for the treatment of tobacco stems which comprises first treating the stems with water to add moisture thereto, followed by cutting the stems in a direction perpendicular to the longitudinal axis of the stem, which is disclosed in the patent to develop improved expansion over cutting techniques which rely on longitudinal cutting direction. This method, like those described earlier, however, is deficient in that it results in stem sections that are non-uniform in length and thickness and therefore less desirable for use as filling material in smoking applications.

SUMMARY OF THE INVENTION

In accordance with the present invention, an improved method is disclosed for the treatment of tobacco stems to provide stem sections of improved uniformity in length and thickness, as well as favorably increased expansion capacity. The method of the present invention comprises providing the tobacco stems in the uncut condition with a moisture content ranging from 15 to 70% relative to the dry weight of the tobacco stems, performing more than one first cut of said tobacco stem in a direction parallel to the longitudinal axis thereof, conditioning the resultingly cut tobacco stem, and performing more than one second cut of said tobacco stem in a direction parallel to said longitudinal axis, wherein the respective longitudinal planes containing said first and said second cuts reside in substantially perpendicular relation to each other.

In one embodiment of the present invention, a plurality of first cuts and second cuts may be made in sequential relationship to each other, by a cutting technique similar to the technique of chip cutting that is well known and widely utilized in the manufacture of a building product know as chip board. Alternately, the present cutting procedure may be performed simultaneously by means of stationary cutting knives or band knives past which the tobacco stems may be moved.

Each of the first cuts is parallel to the other; similarly, each of the second cuts are likewise parallel; however, the first cuts and second cuts are so disposed with respect to each other that the longitudinal planes respectively containing them are generally perpendicular to each other.

In other respects, the method of the present invention contemplates conventional processing, in that the tobacco stems may be subsequently expanded, conditioned or otherwise treated in the course of their preparation for use in applications, such as incorporation in smoking articles. The invention contemplates that the tobacco stems may be conditioned subsequent to making the first cuts. Likewise, the cut tobacco stems may be conditioned after the cutting procedure of the present invention is completed, in accordance with conventional practice in the art.

The tobacco stems treated in accordance with the present invention possess the advantage of uniformity of length and thickness. Also, the present method results in improved response to expansion of the cut tobacco stem sections, and as much as a 20% improvement in expansion per stem section may be realized.

Accordingly, it is a principal feature of the present invention to provide a method for the treatment of tobacco stems which results in the preparation of tobacco stem sections having improved expansion characteristics.

It is a further object of the present invention to provide a method as aforesaid which yields tobacco stem sections exhibiting greater uniformity in section length and thickness.

It is a yet further object of the present invention to provide a method as aforesaid wherein the resulting tobacco stem sections exhibit a reduced incidence of fiber destruction and waste. Other objects and advantages will become apparent to those skilled in the art from a review of the ensuing description.

DETAILED DESCRIPTION OF THE PREFERRED EMBODIMENTS

The present invention relates to a process for treating a tobacco stem to prepare a plurality of stem sections having improved uniformity and expansion characteristics.

The present method comprises providing the tobacco stems in the uncut condition with a moisture content ranging from 15 to 70% relative to their dry weight. Generally, uncut tobacco may be previously treated by curing, and the like, wherein certain residual moisture may be present in the tobacco stems after such processing is completed. The tobacco stems after their separation from the remainder of the tobacco leaf, are frequently reduced in moisture, and may be subjected by conventional techniques to a moisturization by exposure to steam or the like. Generally, it is desirable that the tobacco stems processed in accordance with the present invention contain moisture in amount, as indicated earlier, ranging from 15 to 70% of the dry weight of the tobacco stem. In one embodiment, described herein, the tobacco stems may be processed wherein the moisture content is approximately 40% of the dry weight of the tobacco stem.

The tobacco stems provided above are thereafter subjected to a first cutting step, wherein more than one, and preferably a plurality of parallel first cuts are made in the stem. Although the invention is not specifically limited to the number of first cuts that may be made, the present invention contemplates at least two such first cuts, and preferably as many as eight or more such cuts in the tobacco stem.

As noted earlier, the cutting performed in the present invention may be conducted sequentially by well known techniques such as chip cutting, employed in the preparation of chip or particle board, or alternately may be performed simultaneously by passing the tobacco stem across a plurality of parallel cutting surfaces such as cutting bands or blades. The first cuts made in accordance with the present invention, however, should be parallel to each other and parallel to the longitudinal axis of the tobacco stem.

Subsequent to the completion of the first cutting step, the resulting tobacco stem sections may be conditioned in accordance with conventional processing known in the tobacco industry. Such conditioning is generally employed to render the resulting tobacco stems more compatible with the remainder of the tobacco incorporated into smoking articles and the like.

Subsequent to conditioning, the tobacco stem sections are given a second cutting treatment, wherein more than one, and preferably a plurality, of second cuts are made, parallel to each other and likewise parallel to the longitudinal axis of the stem sections. These parallel second cuts, however, are distinguished in accordance with the present invention in that they all lie in longitudinal planes that are generally perpendicular to longitudinal planes containing the first cuts previously made. In this way, the combined cutting operation yields tobacco stem sections that are more uniform in thickness and length, and less prone to defects such as fiber destruction.

In addition to the processing set forth above, the tobacco stem sections may be treated in accordance with other standard procedures, and may subsequently be conditioned, humidified and dried. As a result of the treatment performed in accordance with the present invention, however, the tobacco stem sections exhibit improved expansibility and resistance to processing. Further, the present method may include the utilization of rollers to assist in maintaining the uniformity of the tobacco stems and in conveying the stems past the cutting means. Any such rollers so employed, however, should be set at a spaced apart relation with respect to each other such that the tobacco stems are compressed within the range of their inherent elasticity only. In this manner, fiber structure is not damaged and the tobacco stems will exhibit the same favorable characteristics outlined above.

For a greater understanding of the present invention, reference is had to the following illustrative example.

EXAMPLE

Uncut tobacco stem material was provided which exhibited a moisture content of approximately 40%, average length of 50 millimeters and stem diameter of an average of 5 millimeters. These stems were split on a chip cutter in the longitudinal direction of the stems in such manner that each stem was divided into an average of 8 longitudinal cuts. The resulting stem sections exhibited a mean cut width of approximately 0.62 millimeters.

These longitudinal first cuts produced stem sections which were then subjected to a plurality of second cuts performed in a plane perpendicular to the plane containing the first cut, at a cutting width of approximately 0.15 millimeters. The resulting fibers were then conditioned and dried. Further examination of the tobacco stem sections revealed that an expansion of approximately 20% occurred during the process, with a corresponding volume increase of 20% achieved per tobacco stem. An average of 211 fibers were received from each stem, the fibers exhibiting dimensions of approximately $0.7\times0.15\times50$ millimeters.

COMPARATIVE EXAMPLE

Tobacco stem material, identical in initial condition to that provided in the Example above, was subjected to conventional processing, and was accordingly rolled to an average thickness of 0.7 millimeters per stem. After rolling, the stems were observed to have been squashed flat, and their fiber structure appeared destroyed. Further, the rolled stems were observed to exhibit increased density resulting from the compression applied by the rolling sequence. The width of the rolled stems was an average of 15 millimeters.

The rolled stems were subsequently cut in a direction perpendicular to the direction of the fibers. As a result, a total of 100 fibers were obtained per average stem, which fibers exhibited dimensions of $0.7\times0.15\times50$ millimeters. These fibers were then conditioned in a similar manner to that described above.

A comparison of the tobacco stem sections prepared above shows that, according to the method of the present invention, more than twice as many fibers or tobacco stem sections were obtained. As a result, the improved filling capacity, of approximately 20% per stem section on the average, was at least twice as great upon further processing with the samples of the present invention, as distinguished from those materials processed in the conventional manner. As stated earlier, these advantages are the result of the fact that the tobacco stems are not rolled or squashed parallel to the longitudinal axis of the stem before cutting, in accordance with the present invention, is performed.

What is claimed is:

1. A method for treating tobacco stems which comprises:

providing the tobacco stems in the uncut condition and having a moisture content of from 15 to 70% relative to the dry weight of the tobacco stems, making more than one first cut in each tobacco stem, each first cut being disposed in a plane substantially parallel to the other and substantially parallel to the longitudinal axis of the tobacco stem, conditioning the cut tobacco stems, and performing more than one second cut in each tobacco stem, each second cut being substantially parallel to the other and to the longitudinal axis of the stem, and each first cut being disposed in a plane substantially perpendicular to the plane of each second cut.

2. The method according to claim 1, all of the first cuts being performed substantially simultaneously and all of the second cuts being performed substantially simultaneously.

3. The method according to claims 1 or 2, said first cutting step being completed prior to commencing said second cutting step.

4. The method according to claim 1, further comprising:

conditioning the cut tobacco stems after said second cutting step.

* * * * *